United States Patent [19]

Romer et al.

[11] Patent Number: 4,555,971

[45] Date of Patent: Dec. 3, 1985

[54] METHOD AND APPARATUS FOR COVERING A TARGET AREA WITH AMMUNITION

[75] Inventors: Rudolf Romer, Kaarst; Christian Jaeneke, Düsseldorf; Karl W. Bethmann, Moers; Manfred Moll, Düsseldorf, all of Fed. Rep. of Germany

[73] Assignee: Rheinmetall GmbH, Düsseldorf, Fed. Rep. of Germany

[21] Appl. No.: 398,242

[22] Filed: Jul. 14, 1982

[30] Foreign Application Priority Data

Jul. 14, 1981 [DE] Fed. Rep. of Germany ..... 3127674

[51] Int. Cl.[4] ..... F42B 25/06; F42B 25/16; B64D 1/04; F41F 5/02

[52] U.S. Cl. ..... 89/1.11; 89/1.51; 102/489

[58] Field of Search ..... 89/1 A, 1.5 R; 102/393, 102/394, 489

[56] References Cited

U.S. PATENT DOCUMENTS

| | | | |
|---|---|---|---|
| 3,093,072 | 6/1963 | Pigman | 102/393 |
| 3,818,833 | 6/1974 | Throner, Jr. | 102/393 |
| 4,172,407 | 10/1979 | Wentink | 89/1 A |
| 4,178,851 | 12/1979 | Brady | 102/393 |
| 4,264,045 | 4/1981 | Campbell | 102/489 |
| 4,318,328 | 3/1982 | Rona | 89/1 A |
| 4,356,770 | 11/1982 | Atanasoff et al. | 102/394 |

FOREIGN PATENT DOCUMENTS

| | | |
|---|---|---|
| 2934620 | 1/1981 | Fed. Rep. of Germany . |
| 1588114 | 4/1981 | United Kingdom . |

*Primary Examiner*—Charles T. Jordan
*Assistant Examiner*—Ted L. Parr
*Attorney, Agent, or Firm*—Spencer & Frank

[57] ABSTRACT

In the method and apparatus for covering a target area with ammunition, a container, which contains active bodies W arranged on different decks 30.1, 30.2 and which is to be brought over the target area, releases the active bodies W through release openings 34 on its sides to become effective from above on respective individual flight paths against objects, for example armored vehicles, present in the target area.

10 Claims, 25 Drawing Figures

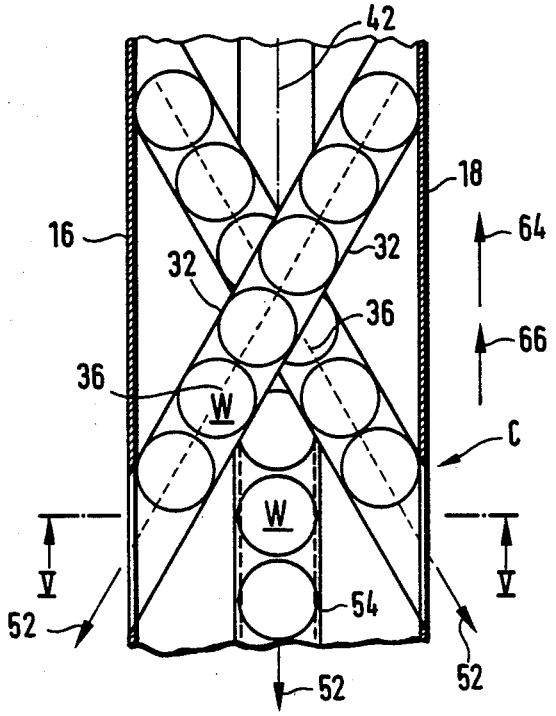
FIG. 4
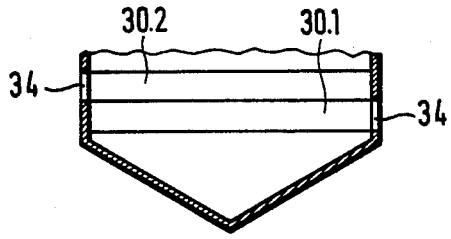
FIG. 5
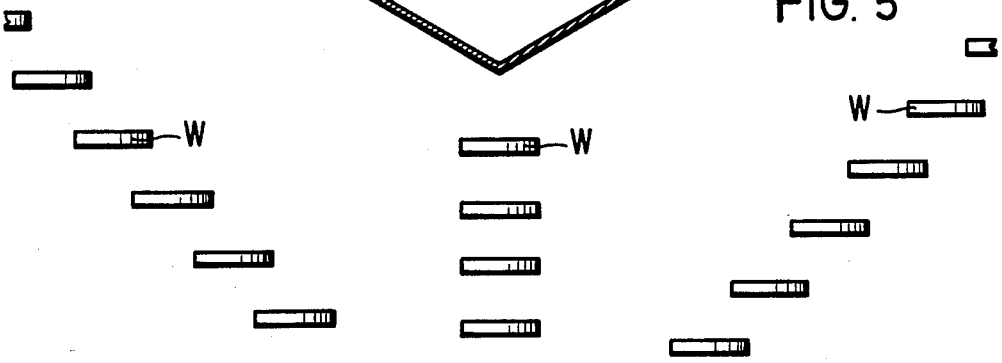

METHOD AND APPARATUS FOR COVERING A TARGET AREA WITH AMMUNITION

BACKGROUND OF THE INVENTION

The invention relates to a method for covering a target area with ammunition using a container filled with a plurality of active units which have an essentially circular cross section and which are dispatched by release means along a controlled path of flight of the container in given quantities on individual paths of flight at at least one given point in time, and in a given direction with respect to the longitudinal axis of the container. The invention also relates to an apparatus for implementing the method.

A method of the above-mentioned type is known wherein active bodies equipped with impact detonators are ejected from a container which is fixed to a carrier. Each active body has its own individual path of flight and must directly hit an individual target, specifically an armored target, disposed in the target area to produce the desired effect. In this known method an area covering effect, in the broadest sense, cannot be realized with a single overflight of the carrier. There exists the additional danger, when the active bodies are ejected at low altitude, that an active body may hit its individual target at a very small angle and thus considerably impair the effectiveness of the hollow charge incorporated in the active body.

SUMMARY OF THE INVENTION

It is an object of the invention to make available a method of the above-mentioned type in which, in addition to sufficient areal coverage, sufficient effectiveness of each individual active body is assured even when dropped from low altitudes.

The above object is accomplished according to the invention in a method of the type described above including the additional steps of moving the container toward the target at a given height; and releasing the active units from the container such that each of the active units rotates about an axis oriented toward the target area and essentially transverse to the direction of release, and such that the velocity of the container at the moment of release and the rate of release of the respective active units is added vectorially. Advantageously, the inventive teachings defined in the other method claims are directed toward a substantially reduced risk inherent in a respective carrier aircraft on a direct approach to the target area. Further advantages become evident from the teachings defined in the claims directed to the apparatus.

The invention will be explained in greater detail below with the aid of the drawings in which details not significant for the invention have been omitted and which are essentially schematic representations showing three embodiments of a container, different further means and details as well as nine embodiments of active units according to the invention and an overview sketch to clarify the effect of the invention when in use.

BRIEF DESCRIPTION OF THE DRAWINGS

FIG. 4 is a sectional top view of a further embodiment of the container with active units shown for clarification;

FIG. 5 is a sectional view along line V—V of the container of FIG. 4 with the active units ejected laterally and in the longitudinal direction;

DETAILED DESCRIPTION OF THE PREFERRED EMBODIMENTS

Figure 1:
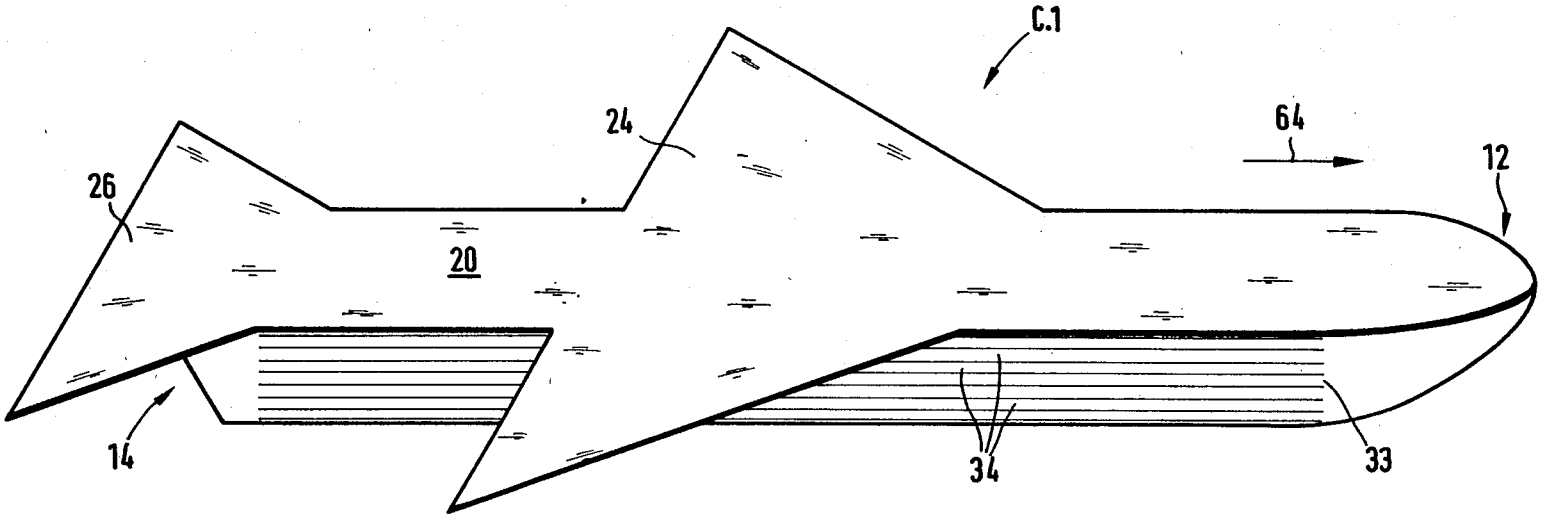
FIG. 1 is a simplified perspective view of a container designed as a gliding missile.

According to FIG. 1, a container is shown in the form of a gliding missile C.1 equipped with wings 24 and a flipper 26. In the region of its nose 12, a search head (not shown) may be disposed. In the region of a cover 20, conventional fastening means (not shown) are provided to unlatch a connection with a carrier aircraft (not shown). Release openings 34 are indicated in both lateral exterior walls, of which only the right wall 18 is visible, the release openings 34 being arranged in superposed rows 33 which extend from the nose region 12 to the tail region 14. In the tail region 14, a booster charge and/or a sustainer may be disposed, both being active in the direction of flight 64.

Figure 2:
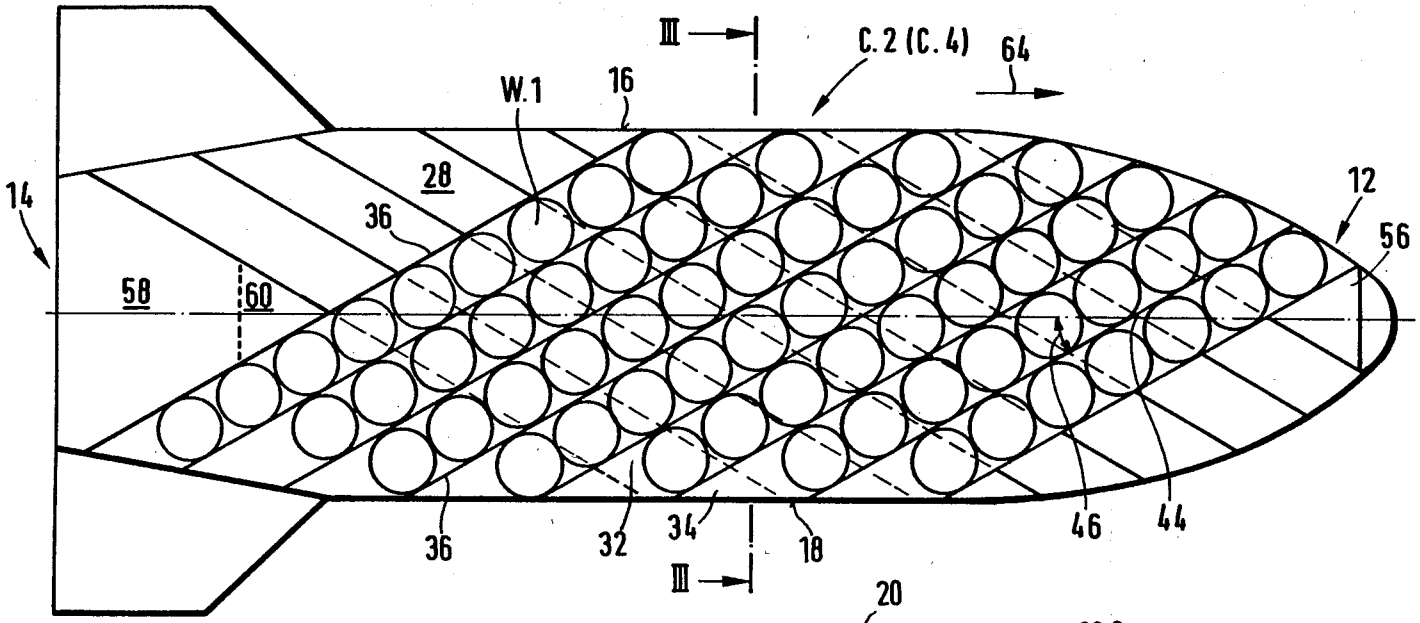
FIG. 2 is a horizontal sectional view along the longitudinal axis of a container designed as a cruise missile with active units shown for clarification.
Figure 3:
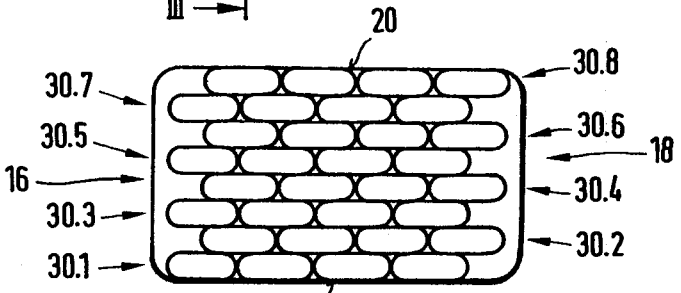
FIG. 3 is a sectional view along the line III—III of the container according to FIG. 2.

FIG. 2 is a schematic representation of a container designed as a cruise missile C.2;4 with parts impairing clarity being omitted. In its interior 28, the container has a plurality of receptacles 32, arranged along parallel straight lines 36, for active units W.1, . . . which are indicated in a simplified manner. As can be seen particularly well in the cross sectional view of FIG. 3, the receptacles 32 are arranged above one another in eight decks 30.1–30.8, with the receptacles 32 of immediately adjacent decks 30.1–30.8 crossing over one another. The straight lines 36 form an acute angle 46 with the longitudinal axis 42 of the container C.2 and the points 44 of the angles 46 lie ahead of the respective release openings 34 when seen in the direction of flight 64. In the tail region 14, a booster charge 60, indicated only schematically, is associated with the sustainer 58, likewise indicated only schematically. The search head 56 indicated in the nose region 12 will be explained later.

FIGS. 4 and 5 show a further embodiment of a missile type container (e.g. a cruise missile) according to the invention for better clarity, FIG. 4 shows only two receptacles 32 arranged in adjacent decks 30.1, 30.2 and crossing over one another, together with the active units W disposed therein. When looking simultaneously at FIG. 5, it can be seen that, in the bottom region 22 of the container C, there is disposed a longitudinal receptacle 54 with active units W, the receptacle extending essentially parallel to the longitudinal axis 42 of the container. Moreover, FIG. 5 shows active units W released from container C. This will be discussed in greater detail below.

Figure 6:
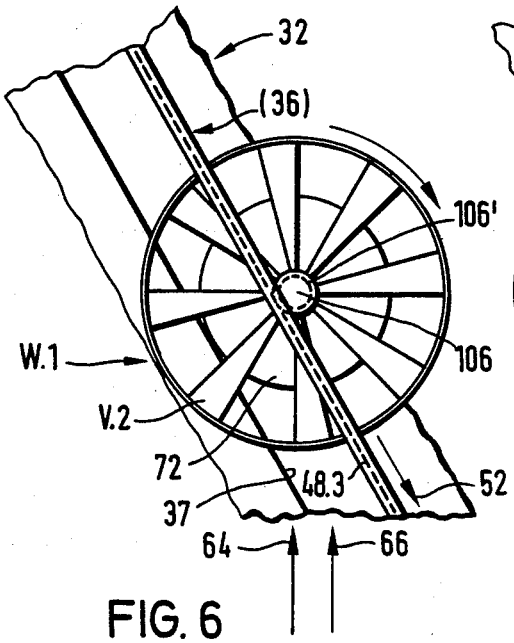
FIGS. 6 and 7 are detail sectional top views of different receptacles for active units.
Figure 8:
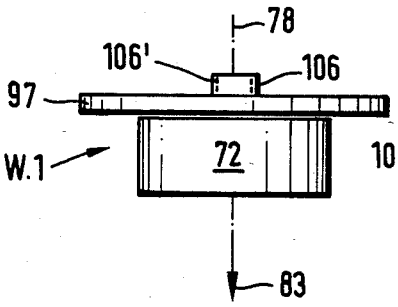
FIG. 8 is a side elevational view of a first embodiment of an active unit of the type shown in FIG. 6.

FIG. 6 is a detailed sectional view of one embodiment of a receptacle 32 in which an active unit W.1 is moved in the release direction 52. The active unit W.1 is of the type as shown in FIG. 8 in a side elevational view.

In addition to a guide 37 for an active body 72, the receptacle 32 is provided with a toothed rod 48.3 for cooperating with a shaft stub 106 equipped with a ring of teeth 106', the stub 106 being part of a rotor 97 equipped with attached profiled blades V.2 for the active body. The rotor 97 is freely rotatable with respect to the active body 72 about a common axis of rotation 78. During movement in the release direction 52, the rotor 97 rotates clockwise while the active body 72 slides along the guide 37.

Figure 7:
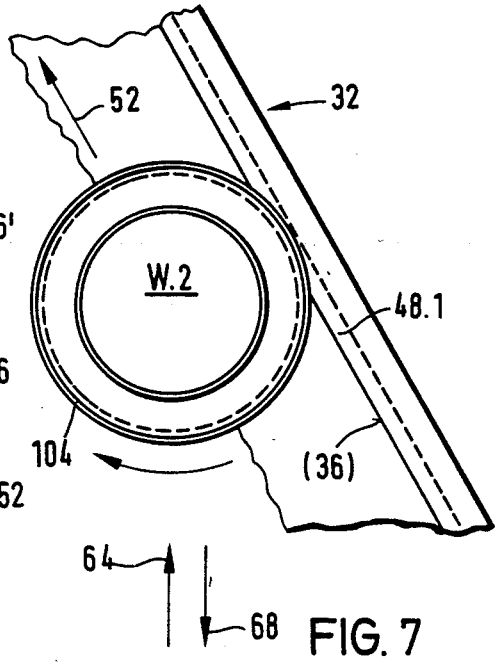
Figure 9:
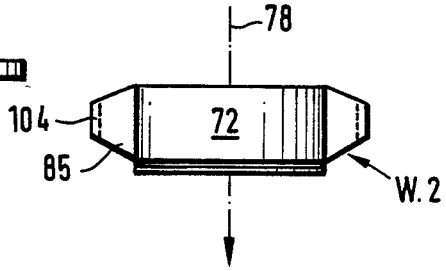
FIG. 9 is a side elevational view of a second embodiment of an active unit of the type shown in FIG. 7.

FIG. 7 is a sectional view of a receptacle 32 of a different design and with another type active unit W.2 as shown in FIG. 9. In its outer region, the active unit W.2 is provided with a ring of teeth 104 which mesh in a form-locking manner with a toothed rod 48.1 arranged to its side. The active unit W.2 moves in the release direction 52 by rotating clockwise around its central axis 78 toward a release opening (not shown). FIG. 9 is a side elevational view which clarifies the design of the active unit W.2 according to FIG. 7. In FIG. 6 as well as in FIG. 7, the toothed rods 48.1, 48.3 extend along their respective straight lines 36 which extend in a direction identical to the respective release directions 52.

Figure 10:
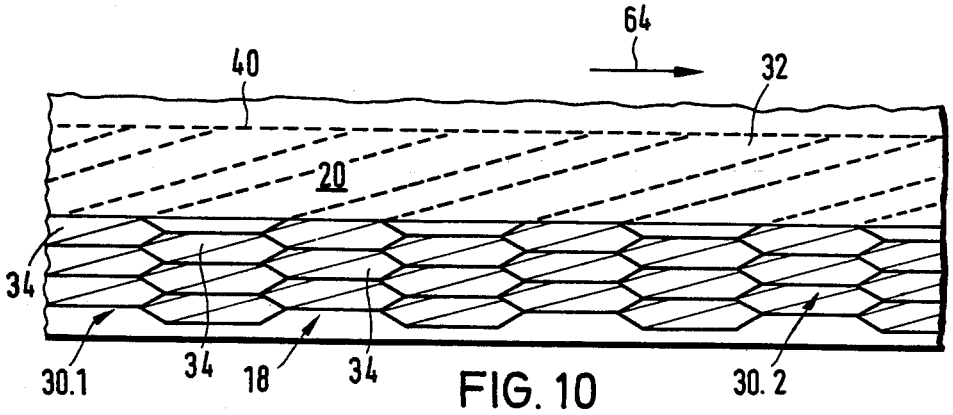
FIG. 10 is a sectional perspective view of a container equipped with receptacles designed as tubes having hexagonal cross sections.

FIG. 10 is a sectional view of the lateral exterior wall 18 of a further embodiment of a container C. The receptacles 32 are designed in the form of tubes having hexagonal cross sections and extend to a center partition 40. Advantageously, the tubes are integrated in the supporting cell structure of the container C and assure good torsional rigidity.

Figure 11:
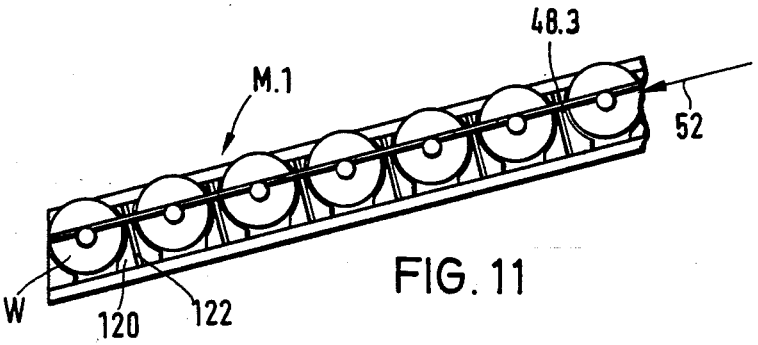
FIG. 11 is a sectional top view of a first magazine for active units for accommodation in and ejection from one of the tubes according to FIG. 10.

FIG. 11 is a sectional view of a first type magazine M.1 for active units W which are spaced from one another by spacers 120, so as not to interfere with one another during their clockwise rotation. Rotation is generated by the toothed rod 48.3 disposed at the top.

Figure 12:
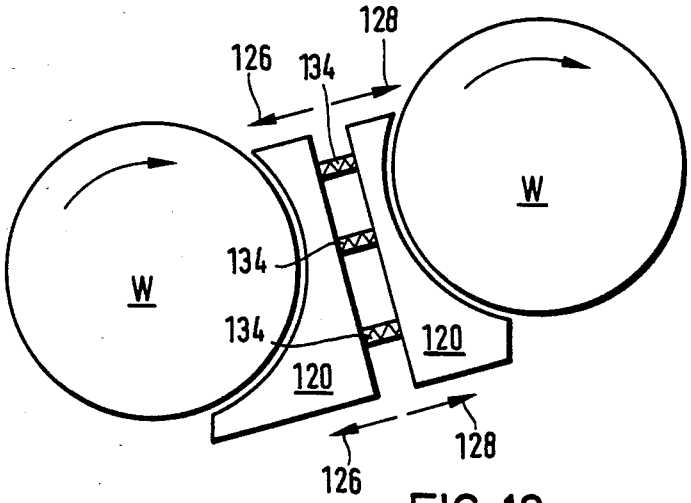
FIG. 12 shows a section XII of FIG. 11 in an enlarged representation.

As can be seen in FIG. 12, the spacers 120 are divided along a parting line 122. In the region of the parting line 122, three compression springs 134 are provided to take care that the two halves of the spacers 120 separate when the respective release opening passes through in the direction of arrows 126, 128 and thus do not interfere with the active units W.

Figure 13:
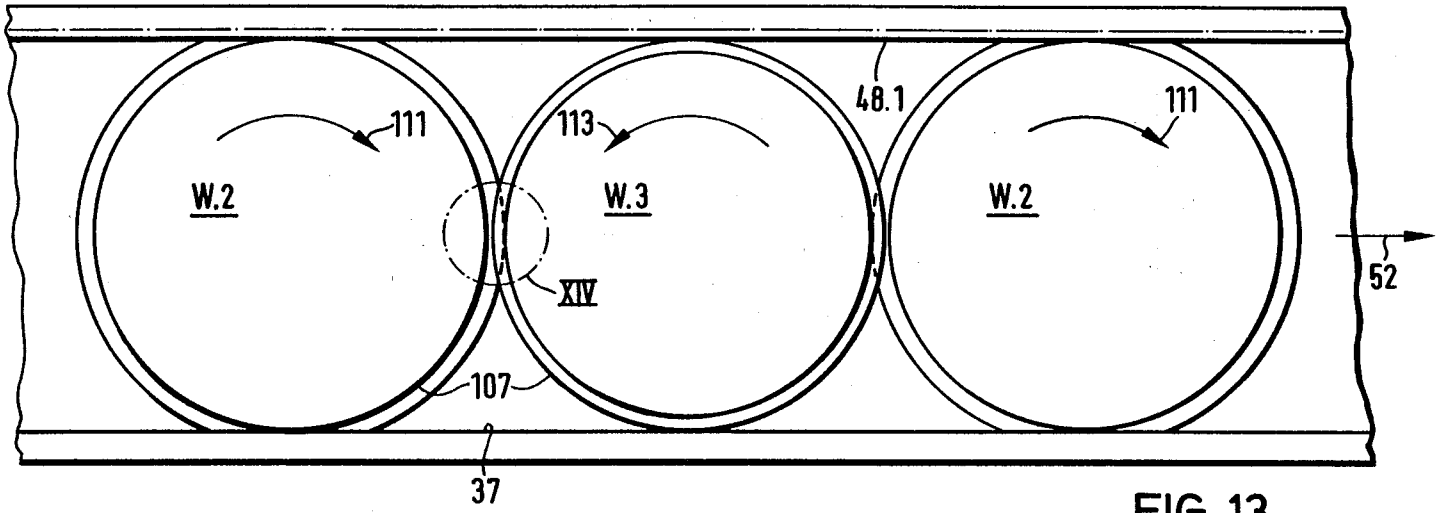
FIG. 13 illustrates a second magazine showing a third and a fourth embodiment of the active units.
Figure 14:
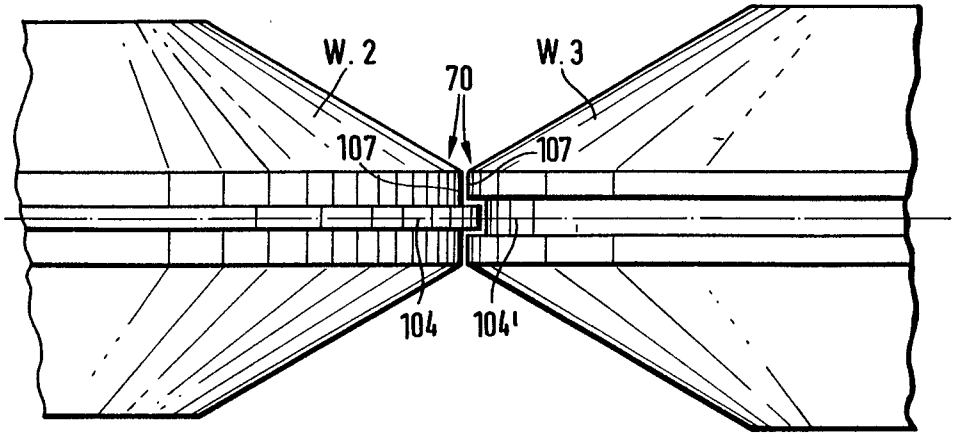
FIG. 14 is a section XIV of FIG. 13 in an enlarged representation.

FIG. 13 shows three active units W.2, W.3 in one receptacle 32 equipped with a lateral toothed rod 48.1, with the two outer active units W.2 being identical while the center unit (W.3) differs, from them in that it has a different circumferential region 70. For clarification, a region XIV outlined by dash-dot lines in FIG. 13 is shown enlarged in FIG. 14. In their circumferential regions 70, the two outer active units W.2 are equipped with a ring of teeth 104 for meshing with the toothed rod 48.1 as well as with a deeper lying toothed ring 104' between two circumferential slide faces 107 of the center active unit W.3. In this way, when the arrangement is moved in the release direction 52, a different torque 111, 113 results for the active units W.2, W.3.

Figure 14A:
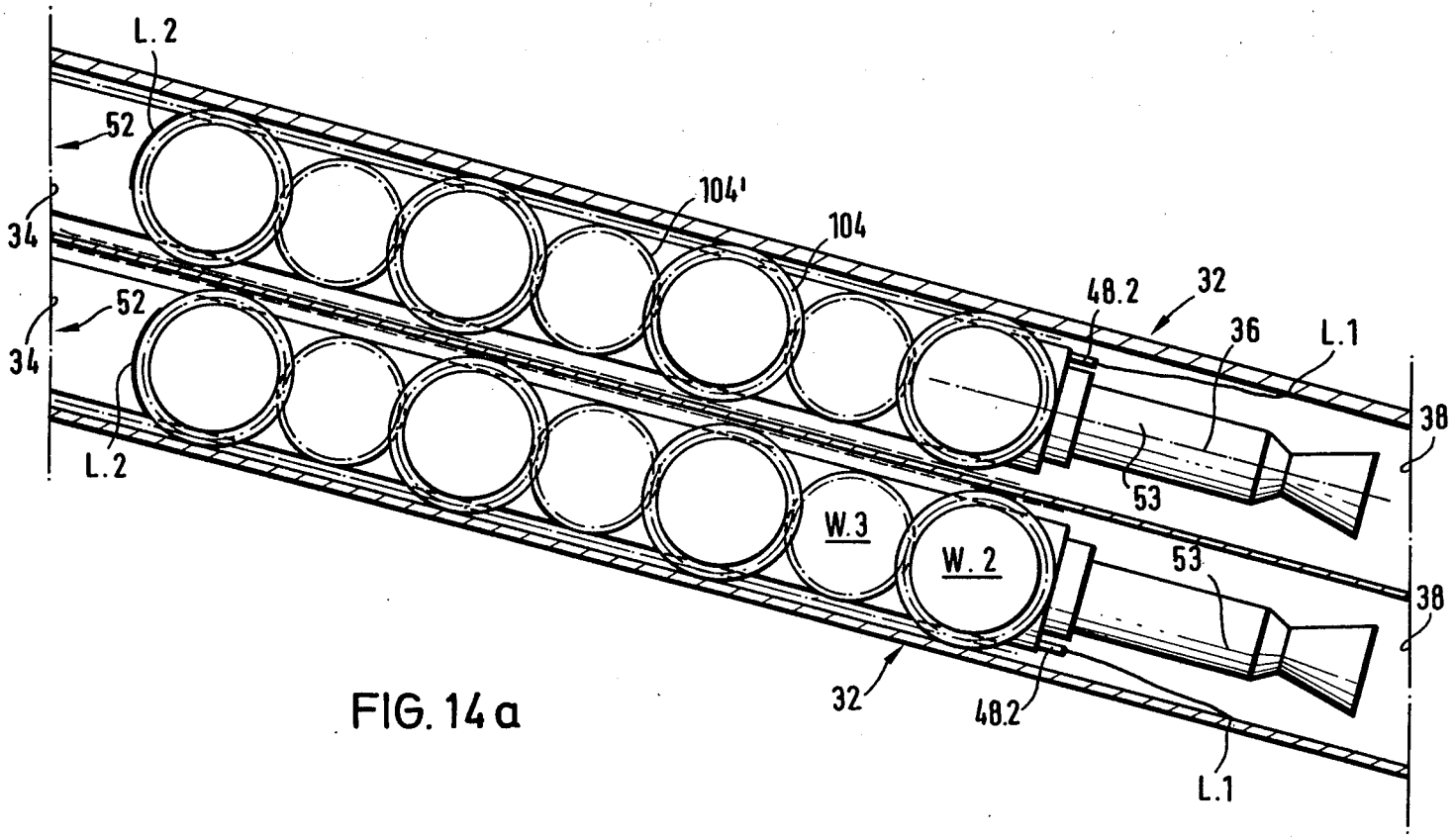
FIG. 14*a* shows two juxtaposed receptacles with indicated magazines and active units according to FIG. 13, each equipped with an ejection device.

FIG. 14*a* shows two receptacles 32 which extend between the two lateral exterior walls 16, 18 of the respective containers C. The arrangement of the active units W.2, W.3 corresponds to that shown in FIGS. 13 and 14, with the magazine M.2 being indicated only.

In the vicinity of an opening 38 in the lateral wall 18, releasing aids are provided in the form of rocket propellant charges 53. In the present case, the form-locking element extending along the line 36 for imparting rotation to the active units is a toothed belt 48.2 whose one end L.1 is fastened in the region of side wall 18. The free end L.2 of the toothed belt 48.2 encloses the circumference 70 of the active unit W.2 disposed farthest to the left in the vicinity of the release opening 34. During movement in the release direction 52, the free end L.2 of the toothed belt 48.2 is initially stretched so that the respective outer active unit W.2 is put into sufficient rotation.

Figure 15:
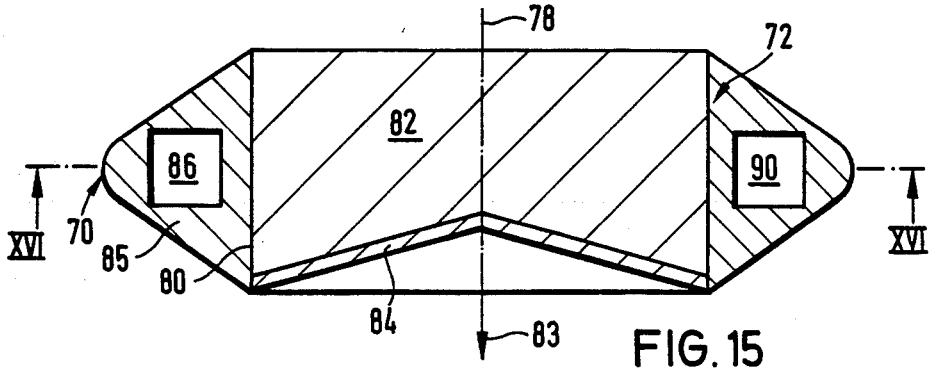
FIG. 15 is a vertical sectional view of a fifth embodiment of the active units.
Figure 16:
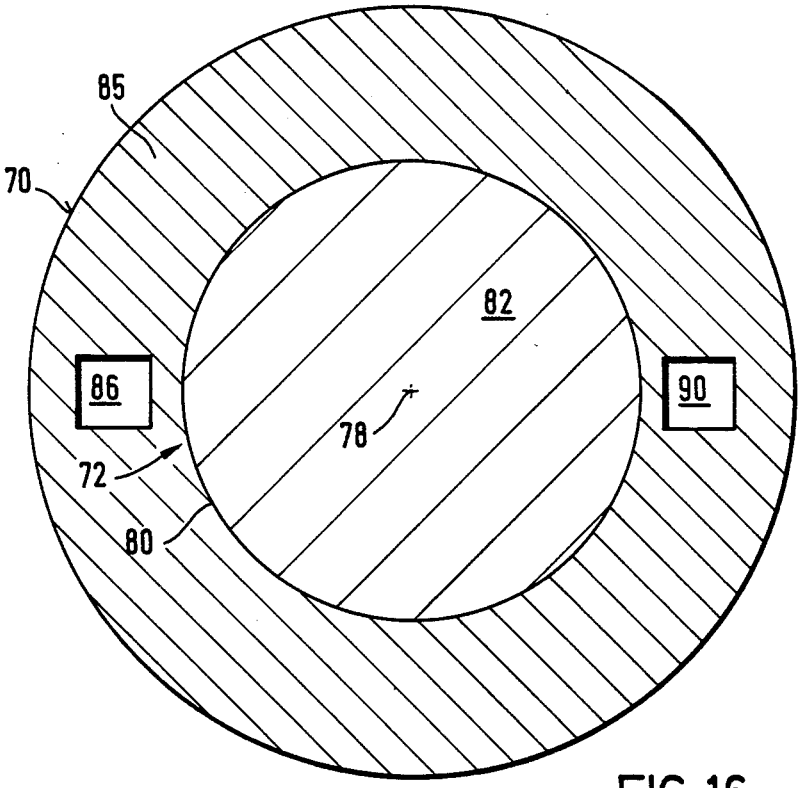
FIG. 16 is a sectional view along the line XVI—XVI of the active unit according to FIG. 15.

FIGS. 15 and 16 show a fifth embodiment of an active unit W.5. A circularly cylindrical wall 80 encloses a charge 82 which is limited at its underside by a P charge insert 84, so that the actual active body 72 results from the arrangement of the wall 80 and of the insert 84. At least one sensor 86 and the detonator 90 actuated thereby are cast in the customary manner into a circumferential circular ring 85 having an essentially triangular cross section and are connected with the charge 82 in a manner not shown so as to make it effective. One effective axis 82 of the P charge is coextensive with the axis of rotation 78; the effective direction of the sensor (or sensors) 86 essentially coincides with that of the P charge of the active body 70.

Figure 17:
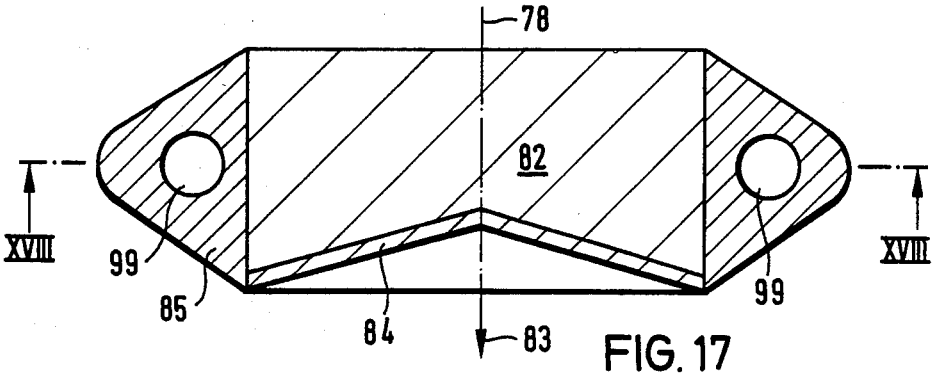
FIG. 17 is a vertical sectional view of a sixth embodiment of the active units.
Figure 18:
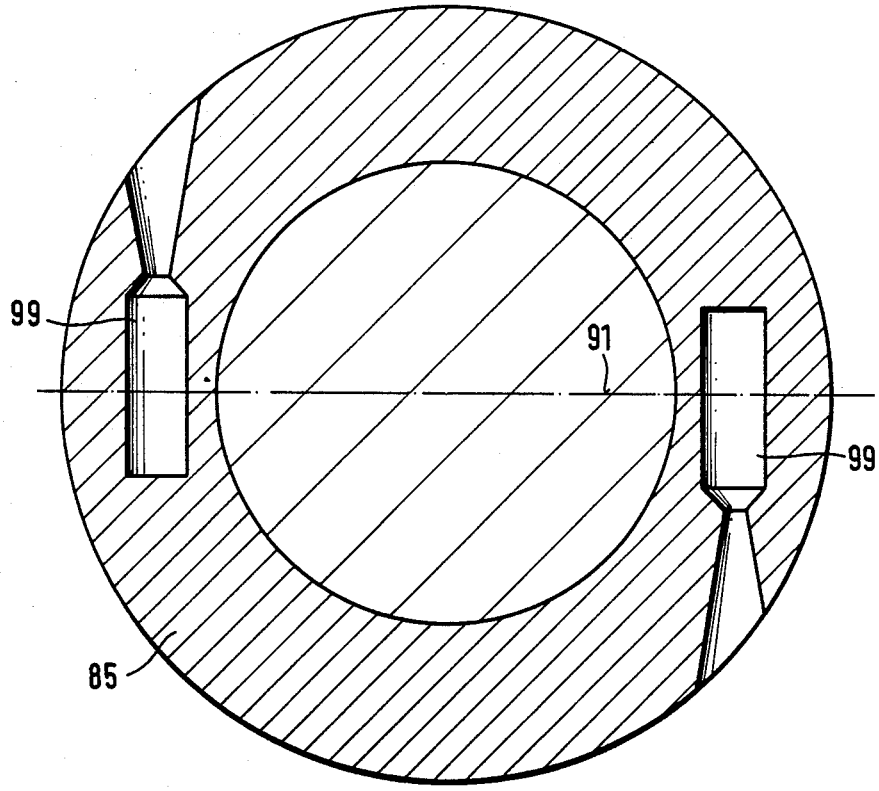
FIG. 18 is a sectional view along the line XVIII of the active unit according to FIG. 17.

FIGS. 17 and 18 show a sixth embodiment of an active unit W.6 equippd with rocket propellant charges 99 arranged oppositely to one another on a diameter 91 of the circumferential circular ring 85 to assure sufficient rotation about the axis of rotation 78 which coincides with the effective axis. For reasons of simplicity the illustration of further detail has been omitted—as is the case in FIGS. 15 and 16. The rocket propellant charges are fired, in a manner not be described in detail, only after the respective release opening has been passed.

Figure 19:
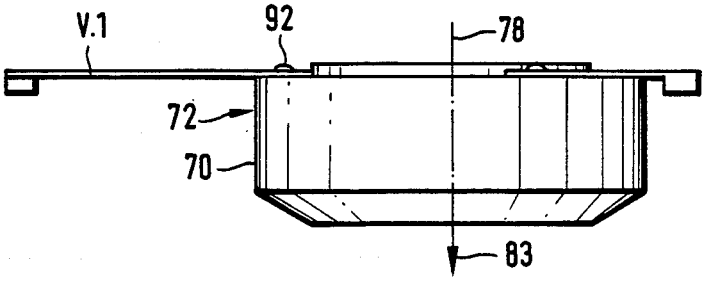
FIG. 19 is a side elevational view of a seventh embodiment of the active units.
Figure 20:
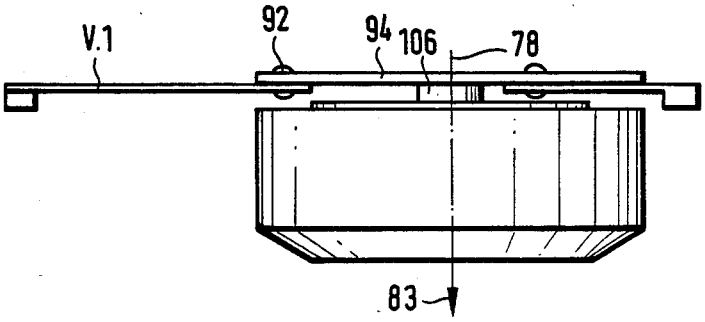
FIG. 20 is a side elevational view of an eighth embodiment of the active units.
Figure 21:
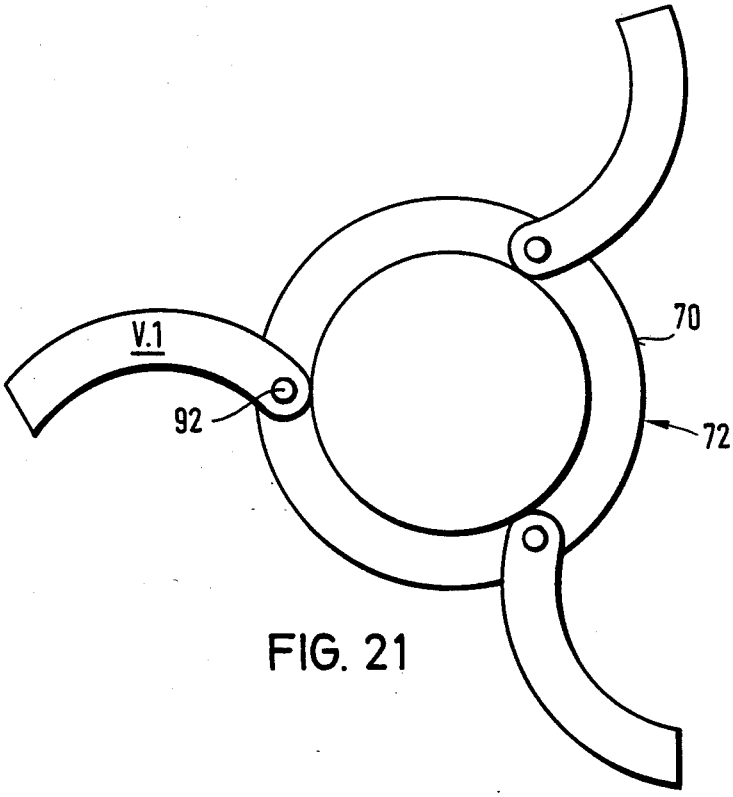
FIG. 21 is a top view of the active unit according to FIG. 19.

The active units W.7 according to FIGS. 19, 20 and 21 are provided with circularly curved wings V.1 which are articulated, at the upper side of the active units, to be foldable about a respective center of rotation 92. Prior to release from the missile, these wings V.1 are held together in the interior 28 of the missile by means (not shown) to form a circular ring and, after the release from the missile, the wings, are unfolded by the rotation in the manner illustrated in FIG. 21 of the drawings as a result of their known form-locking connection. While, in the case of the embodiment of FIG. 19, the wings V.1 are articulated directly at the upper side of the active body 72, the active unit W.8 according to FIG. 20 is provided with a disc 94 which is freely rotatable in a known manner with respect to the active body 72 (see FIGS. 7 and 9), and the wings are articulated to the circumference of this disc 94.

Figure 22:
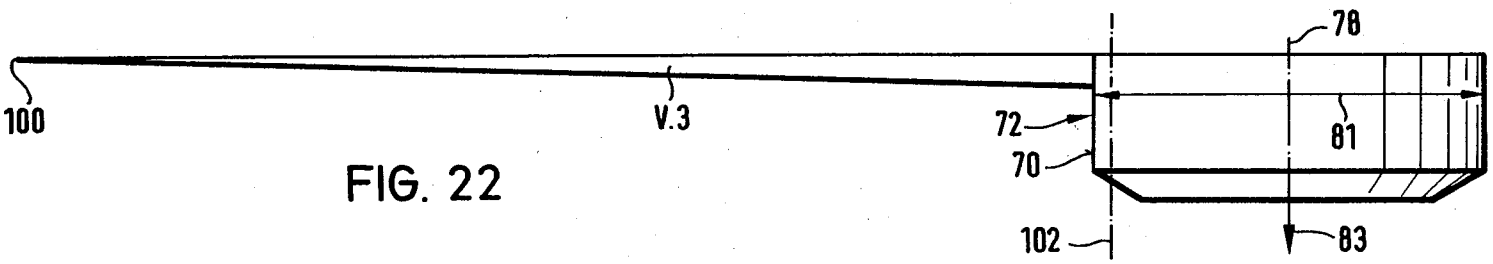
FIG. 22 is a side elevational view of a ninth embodiment of the active units in asymmetrical design.
Figure 23:
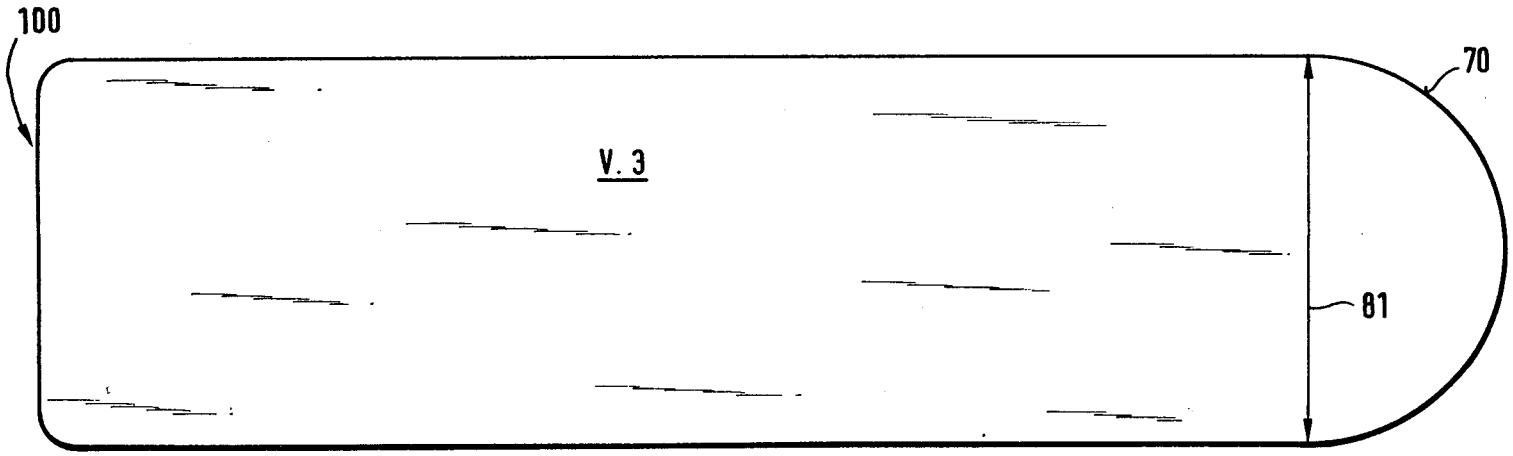
FIG. 23 is a top view of the active unit according to FIG. 22.

FIGS. 22 and 23 show a ninth embodiment of an active body device W.9 in asymmetrical design. A foil V.3 having an essentially rectangular cross section and dimensions transversely to the longitudinal direction which correspond to the diameter 81 of the active body 72, is fastened at the upper side of the active body 70 and tapers from the wall 70 of the active body toward the free end 100 of the foil. For an active unit W.9 of this type, the form-locking elements in the region of the receptacle in the missile are not required; they are arranged essentially above and next to one another in the form of shingles in the respective release tube so that they leave the respective release opening with the free end 100 of foil V.3 in the lead. The initial path of flight is essentially dependent on the ejection force and a magazine (not shown) is moved toward the respective release opening by a releasing aid in the form of a rocket propellant charge. In this embodiment, rotation occurs about an axis outside the axis of rotation 78 of the active body 72 with the advantageous result that the extension (not shown) of the effective axis 83 of the active body 72 describes a cycloid on the target area 130 and thus assures for the active unit W its own effective corridor of given width extending on the path of flight projection of the active unit W.

Figure 24:
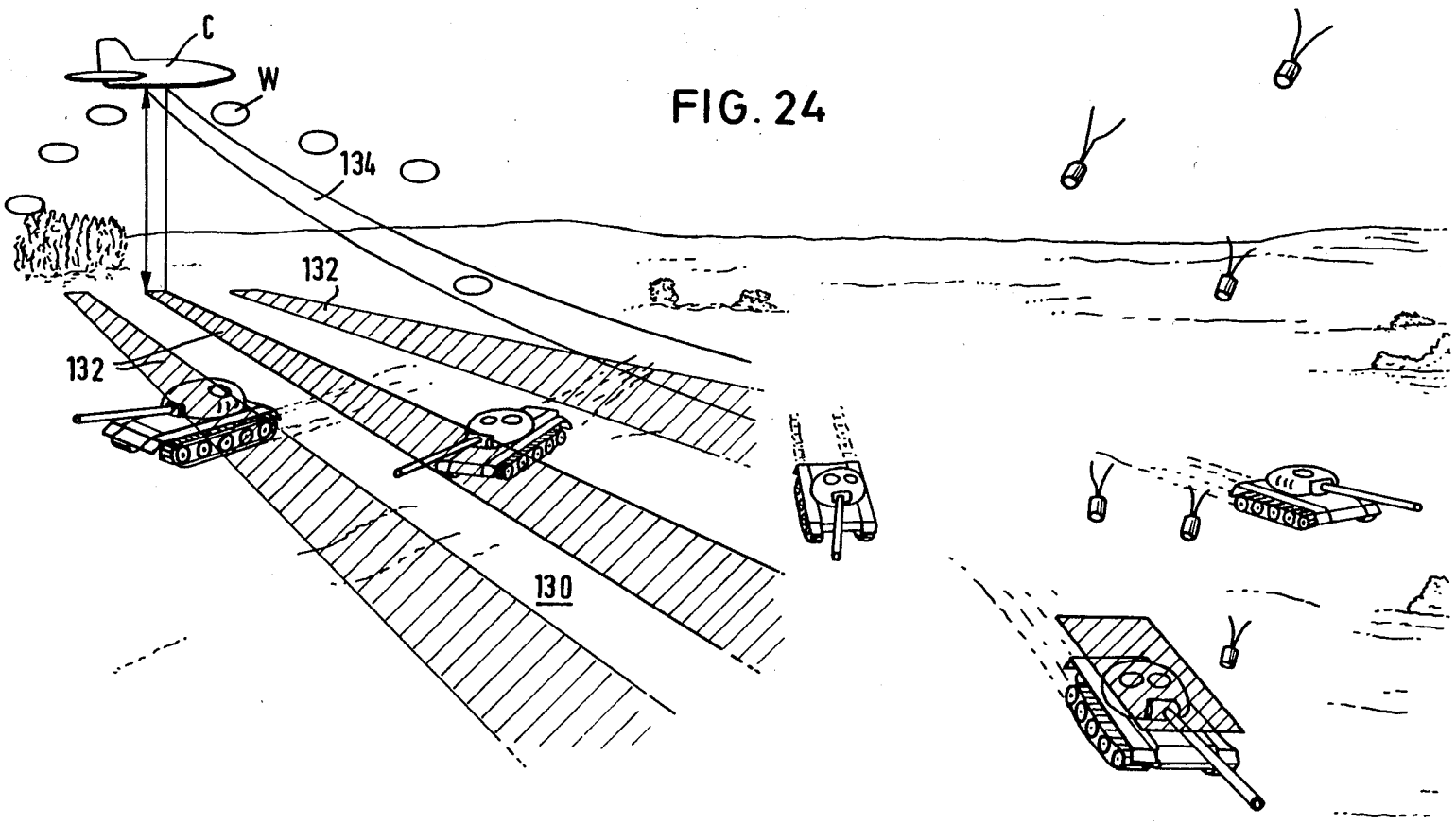
FIG. 24 is an overview sketch to clarify the effect of the invention in use compared to a prior art process sketched in the right-hand half of the figure.

The left half of FIG. 24 shows in an illustrative but simplified representation the principle of operation of the invention. While each ejected active unit W has its own corresponding, associated action corridor 132, of which only a single one is shown, so that this results in a substantially complete areal coverage of the target area 130, the illustration in the right half of the drawing, which relates to a prior art method, clearly shows the difference in effect.

In those cases where a releasing aid in the form of a rocket propellant charge is not required, the inertial forces are utilized which act, during positive or negative acceleration, on the respective active unit as a result of the respective receptacles being arranged at an acute angle with the longitudinal axis of the container, thus assuring the respective releasing process as a result of the motion component oriented outwardly in the direction of the respective line 36.

If the container is used while being fixed to a carrier, the release takes place at a right angle to the longitudinal axis of the projectile or at an acute angle toward the rear so that the carrier aircraft is not endangered by its own stray ammunition.

According to a further variation in which the points of the angles are disposed between the lines 36 and the longitudinal axis 42 of the container in front of the respective release opening, the flipper 26 is simultaneously actuated after firing of a booster charge 60 so that the container bulges at its front end and the active bodies leave the release opening as shown under their own gravity with a corresponding rotation.

If the units are inertially released during horizontal flight, essentially the releasing scheme shown in FIG. 5 will result and the provision of the described longitudinal receptacle will then avoid with certainty the creation of a "neutral corridor".

If a search head 56 is integrated in the container, a computer and other known devices can be used to assure that the releasing process takes place either by deck or by tube, resulting advantageously in an ammunition saving way to combat individual targets in a respective target area.

We claim:

1. A method for covering a target area with scattered ammunition from a container, wherein the ammunition to be scattered is in the form of active units having an essentially circular cross section disposed in a plurality of essentially linear receptacles closed at one end and provided with an outlet opening, wherein a plurality of the receptacles enclose an acute angle with the longitudinal axis of the container and at least one of the receptacles is arranged parallel to the longitudinal axis of the container, and wherein a plurality of active units are disposed in each receptacle, said method comprising the steps of:

moving the container with the active units toward the target at a given height;

discharging the active units from the container by a sudden change of acceleration of the container to cause the active units to move with respect to the container under the effect of their inertial mass in the direction toward the outlet opening and leave the container through said outlet opening to embark on an individual flight path toward the target surface; and, during the movement of the active units in said receptacles, causing the active units to rotate about their axis of rotational symmetry, which is simultaneously their active axis.

2. A method as defined in claim 1 wherein the vertexes of the acute angles of the receptacles with the longitudinal axis of the container and the closed ends of the receptacles are disposed ahead of the respective outlet openings when seen in the direction of flight of the container; and said step of discharging includes positively accelerating the container to discharge the active units.

3. A method as defined in claim 2 wherein said container is a gliding missile and said step of discharging includes firing a booster charge which acts in the direction of flight of the missile.

4. A method as defined in claim 1 wherein the vertexes of the acute angles of the receptacles with the longitudinal axis of the container and the closed ends of the receptacles are disposed behind the respective outlet openings when seen in the direction of flight of the container; and said step of discharging includes decelerating the container to discharge the active units.

5. A method as defined in claim 4 wherein said container is a gliding missile and said step of discharging includes firing a retro-rocket charge to decelerate the missile.

6. A method for covering a target area with ammunition using a container, which is a gliding missile, filled with a plurality of active units which have an essentially circular cross section and which are dispatched by release means along a controlled path of flight of the container in given quantities on individual paths of flight at at least one given point in time and in a given direction with respect to the longitudinal axis of the container, comprising the following steps:

moving the container with the active units toward the target area at a given height;

releasing the active units from the container in a lateral direction which forms an acute angle with the longitudinal axis of the container, with the vertex of said acute angle being disposed in front of the point of release of the active unit from the container when seen in the direction of flight, said step of releasing including firing a booster charge which acts in the direction of flight to accelerate the missile, whereby the active units will be carried out of the missile; and, no later than after leaving the container, causing at least a part of each active unit to rotate about an axis which is essentially transverse to the direction of release and oriented downwardly toward the target area during descent of the active unit.

7. A method for covering a target area with ammunition using a container, which is a gliding missile, filled with a plurality of active units which have an essentially circular cross section and which are dispatched by release means along a controlled path of flight of the container in given quantities on individual paths of flight at at least one given point in time and in a given direction with respect to the longitudinal axis of the container, comprising the following steps:

moving the container with the active units toward the target area at a given height;

releasing the active units from the container in a lateral direction which forms an acute angle with the longitudinal axis of the container, with the vertex of said acute angle being disposed behind the point of release of the active unit from the container when seen in the direction of flight, said step of releasing including firing a retro-rocket charge to decelerate the missile, whereby the active units will be carried out of the missile; and, no later than after leaving the container, causing at least a part of each active unit to rotate about an axis which is essentially transverse to the direction of release and oriented downwardly toward the target area during descent of the active unit.

8. Method according to claim 6 or 7, wherein an extension of said axis of said active unit along a projection of the flight path into the target area sweeps a corridor of a given width on said target area.

9. A method as defined in claim 6 or 7 wherein said step of releasing includes simultaneously releasing a plurality of active units from both lateral sides of the container along respective flight paths, with each active unit being released in a lateral direction which forms said acute angle.

10. A method as defined in claim 9 wherein said lateral direction of each of the active units forms the same said acute angle.

* * * * *